US009868030B2

(12) United States Patent
Donovan et al.

(10) Patent No.: US 9,868,030 B2
(45) Date of Patent: Jan. 16, 2018

(54) CHEMILUMINESCENT SWIM GOGGLES

(71) Applicants: Clare Donovan, River Ridge, LA (US); Flo Donovan, River Ridge, LA (US)

(72) Inventors: Clare Donovan, River Ridge, LA (US); Flo Donovan, River Ridge, LA (US)

( * ) Notice: Subject to any disclaimer, the term of this patent is extended or adjusted under 35 U.S.C. 154(b) by 794 days.

(21) Appl. No.: 14/265,327

(22) Filed: Apr. 29, 2014

(65) Prior Publication Data

US 2015/0306460 A1 Oct. 29, 2015

(51) Int. Cl.

| | |
|---|---|
| ***A41D 31/00*** | (2006.01) |
| ***A63B 33/00*** | (2006.01) |
| ***A41D 13/01*** | (2006.01) |
| ***A41D 13/012*** | (2006.01) |
| ***C09K 11/77*** | (2006.01) |

(52) U.S. Cl.

CPC ..... *A63B 33/002* (2013.01); *A41D 13/01* (2013.01); *A41D 13/012* (2013.01); *A41D 31/0011* (2013.01); *C09K 11/7734* (2013.01); *A63B 2033/004* (2013.01)

(58) Field of Classification Search

CPC .. A63B 33/002; A41D 13/01; A41D 31/0011; C09K 11/7734

See application file for complete search history.

(56) References Cited

U.S. PATENT DOCUMENTS 3,835,848 A * 9/1974 Berner ..... A61F 5/08 606/204.45
4,208,300 A * 6/1980 Gravisse ..... C09K 11/00 252/301.16
4,380,580 A * 4/1983 Boguslaski ..... C07D 209/48 422/400
4,468,819 A * 9/1984 Ohno ..... A61F 9/022 2/430
4,759,453 A * 7/1988 Paetzold ..... A61J 9/00 215/11.1
4,798,497 A * 1/1989 Bloos ..... B63C 11/30 405/185
5,046,200 A * 9/1991 Feder ..... A61F 9/027 128/207.11
5,189,445 A * 2/1993 Stagner ..... G02C 7/16 351/45
5,341,516 A * 8/1994 Keim ..... A61F 9/027 2/424
5,408,702 A * 4/1995 Chiang ..... A63B 33/002 2/428
5,545,834 A * 8/1996 Singh ..... C07D 471/10 252/301.16
5,717,453 A * 2/1998 Wohlstadter ..... G02B 3/14 348/46
5,727,259 A * 3/1998 Kawamata ..... A44B 11/2592 2/452
5,764,335 A * 6/1998 Berke ..... A42B 1/247 351/41
5,813,056 A * 9/1998 Ambrose ..... A63B 33/002 2/428

(Continued)

*Primary Examiner* — Richale Quinn
(74) *Attorney, Agent, or Firm* — Zachary Christiansen

(57) ABSTRACT

This invention is a combination chemiluminescent band and frame, which allows one to swim at night or be worn at parties. It can be seen from behind, has a large surface area for band visibility and interchangeable lenses. It chemical composition allow it to be rapidly be recharged by lights, and exhibit bright visible light from a distance, but also allows for structural integrity of the material when used by swimmers.

9 Claims, 7 Drawing Sheets

(56) References Cited

U.S. PATENT DOCUMENTS 6,002,000 A * 12/1999 Singh ..... C07D 471/10 252/301.16
6,138,287 A * 10/2000 Chou ..... A63B 33/002 128/207.11
6,196,680 B1 * 3/2001 Novak ..... G02C 11/02 351/158
6,748,608 B1 * 6/2004 Fukazawa ..... A63B 33/002 2/428
2002/0004942 A1 * 1/2002 Bryan ..... A23G 3/366 800/288
2003/0037367 A1 * 2/2003 Fukasawa ..... A63B 33/002 2/428
2003/0093853 A1 * 5/2003 Maloney ..... A42B 3/185 2/425
2003/0172445 A1 * 9/2003 Kawashima ..... B63C 11/12 2/452
2004/0158916 A1 * 8/2004 Sung ..... A63B 33/002 2/426
2005/0088611 A1 * 4/2005 Paolino ..... G02C 3/003 351/44
2005/0120468 A1 * 6/2005 Kawashima ..... A61F 9/026 2/444
2005/0241051 A1 * 11/2005 Matsumoto ..... A63B 33/002 2/426
2007/0024807 A1 * 2/2007 Furry ..... G02C 11/02 351/115
2012/0160989 A1 * 6/2012 Yasuhara ..... A63B 33/002 248/693
2012/0206920 A1 * 8/2012 Michelsen ..... G02B 5/08 362/308
2012/0233825 A1 * 9/2012 Chou ..... A63B 33/002 24/68 E
2012/0311773 A1 * 12/2012 Anderson ..... A63B 33/002 2/431
2013/0074249 A1 * 3/2013 Chou ..... A63B 33/002 2/448
2013/0293826 A1 * 11/2013 Batey ..... G02C 5/001 351/62
2015/0128385 A1 * 5/2015 Kuo ..... A44B 11/006 24/193
2015/0238821 A1 * 8/2015 Gallo ..... A63B 33/002 2/431
2016/0067097 A1 * 3/2016 Westgarth ..... A61F 9/027 2/452
2016/0107035 A1 * 4/2016 Chou ..... A63B 33/002 2/452

* cited by examiner

CHEMILUMINESCENT SWIM GOGGLES

CROSS-REFERENCE TO RELATED APPLICATIONS

Not applicable.

STATEMENT REGARDING FEDERALLY SPONSORED RESEARCH AND DEVELOPMENT

Not applicable.

REFERENCE TO SEQUENCE LISTING APPENDIX

Not applicable.

BACKGROUND OF INVENTION FIELD OF THE INVENTION/TECHNICAL FIELD

The present invention is in the technical field of apparel: More particularly, the present invention is in the technical field of goggles.

RELATED ART OF THE INVENTION

People have been using glow in the dark products (chemiluminescent) for many decades and subset of these uses are for eye wear products. There are several reasons that chemiluminescent eyewear exist. The first is novelty. Chemiluminescent novelty items allow a group or gathering of people to have fun when navigating in a dark space where the glowing features of the apparel is the only thing that is seen. For example, there is a product similar to the present invention, which are sunglasses with a phosphorescent bottom portion of the frame. However, they are not for swimming, not goggles and thus does not have a goggle band.

Similarly there are wind goggles that are made for a dog for riding in a sidecar or convertible referred to below as the dog wind goggles. It has phosphorescent materials for fluorescence in the frame region, but have holes in the side, have a non-lit band and could not be used for swimming without accommodating structural changes.

In addition, chemiluminescent and luminescent objects also exist for location and safety, such that when the lights go out, things can be found or located in the dark. For example, there are circular phosphorescent goggles with dark tinted lenses for welding, with a chemiluminescent ring around one portion of the frame for each eye. The welding glasses are useful both as a safety feature and for location, however they are not for swimming or locating swimmers nor could perform these functions due to structural differences.

Night swimming is common for youths but visibility is an important factor in swimming safety. For example, several states have different regulations for supervision based on line of sight or pool area. Texas regulations state that:

(1) A post-Oct. 1, 1999 pool that has a diving board(s) shall have at least one elevated lifeguard chair, located to provide a clear unobstructed view of the pool bottom in the diving area and shall comply with the following.

(A) The seat of the lifeguard chair in the diving water area shall be located at an elevation at least 4 feet above the pool deck. The lifeguard chair may be portable so that its location can be optimized to prevent glare and provide proper supervision.

(B) If the width of the pool is 45 feet or more, an additional elevated chair or station shall be provided and shall be located in the diving area on the opposite side of the pool.

(C) Such lifeguard platforms or chairs shall be placed in locations to reduce sun glare on the water, and in positions which allow complete visual coverage of the pool and the pool bottom within a field of view no greater than 90 degrees on either side of a line of sight extending straight out from the platform or chair.

In addition, New York state regulations are:

"when pools exceed 3,400 square feet of pool surface area at least one additional aquatic supervisory staff shall be provided when the number of bathers exceeds or is likely to exceed 50 percent of the pool bather capacity, based on 25 square feet of pool surface area per bather."

Further, Oregon regulations state:

"(2) There shall be one lifeguard chair or elevated lifeguard platform for each 120 feet (36.6 m) of pool perimeter and with the exception of (3) of this section may be spaced at the discretion of the pool operator.

(3) Where more than one lifeguard chair or elevated lifeguard platform is required, there shall be one chair or platform located on each side of the pool."

In addition, there are swimming goggles with battery powered light emitting diodes (LED) embedded, but not chemiluminescent. These items do light in a dark pool, however they cannot be seen from behind (i.e. the band is not chemiluminescent), which may be a safety concern, and require batteries for maintenance. Thus, an invention that is capable of showing a swimmer at night, underwater, from multiple angles by having a large surface area within which to project this illumination would increase safety and fun for night swimming.

GENERAL SUMMARY OF THE INVENTION

This invention is a combination chemiluminescent band and frame, which allows one to swim at night. It can be seen from behind, has a large surface area for band visibility and interchangable lenses. It is an objective of the invention to have an unobstructed view of night-time phosphorescence of swim goggles. It is yet another objective of the invention to be able to easily locate a swimmer within a typical lifeguard range at night by phosphorescent goggles. It is yet another objective of the invention to be able to recharge phosphorescent goggles by holding them up to a pool light. Finally, it is yet another objective if this invention to have a large band surface area that is phosphorescent so that floating hair does not block the emitted light.

DETAILED DESCRIPTION OF THE INVENTION

Figure 1:
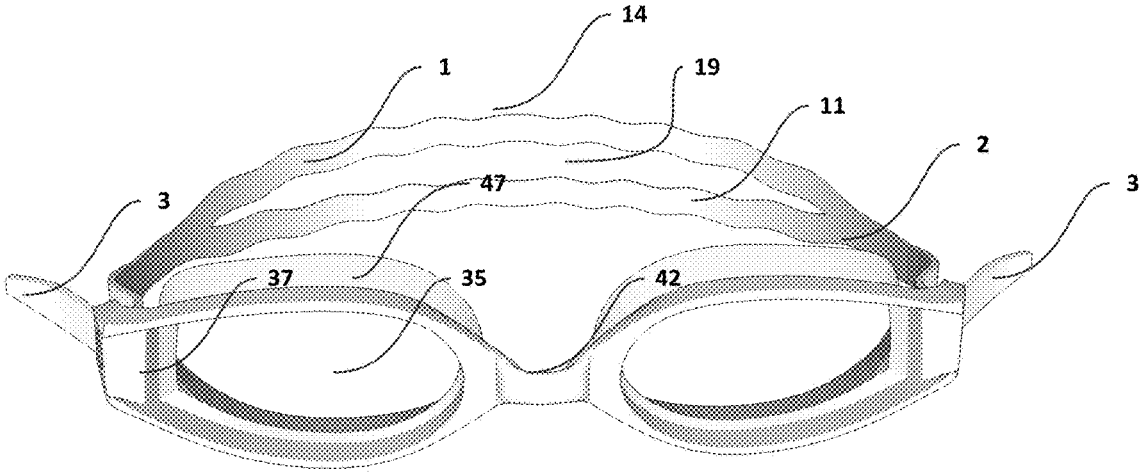
FIG. 1 is an top-down dorsal view that exhibits the overall design of the chemiluminescent swim goggle frame and band.
Figure 2:
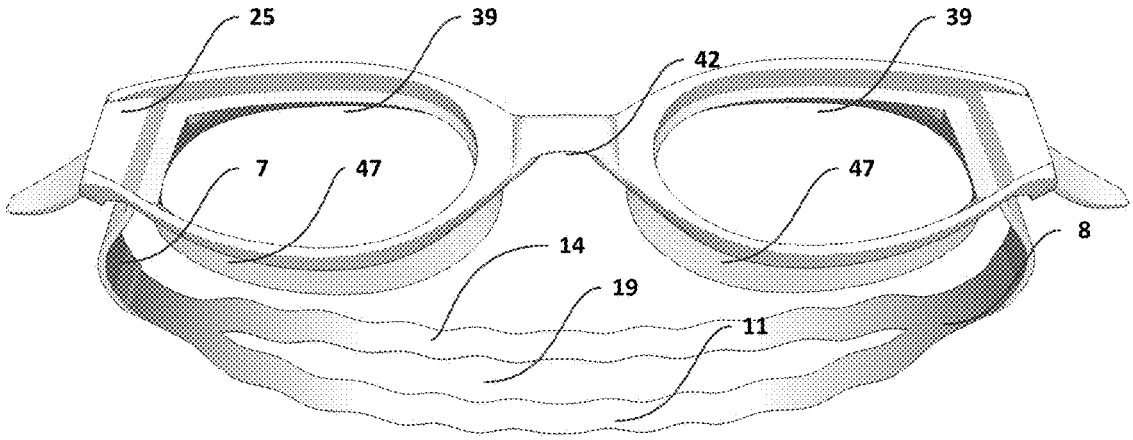
FIG. 2 is an bottom-up ventral view that exhibits the overall design of the chemiluminescent swim frame and band.
Figure 3:
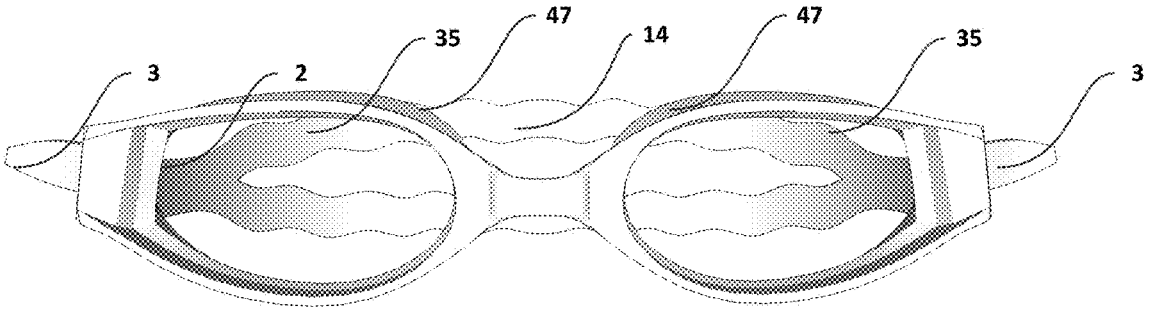
FIG. 3 is an face-on perspective view that exhibits the chemiluminescent swim frame showing the inset wherein the lenses are placed.
Figure 4:
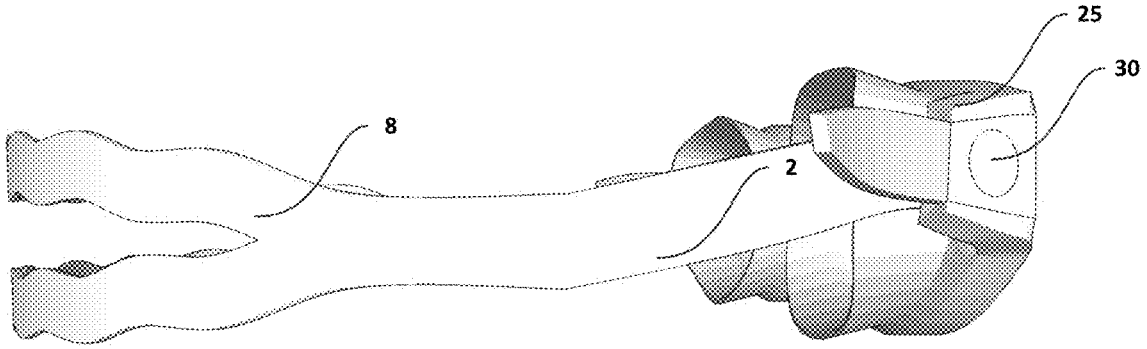
FIG. 4 is an detail view that exhibits the chemiluminescent band showing the Y-shaped split of the band into a dorsal and ventral component, with each component having the shape of waves on their respective dorsal and ventral edges respectively.
Figure 5:
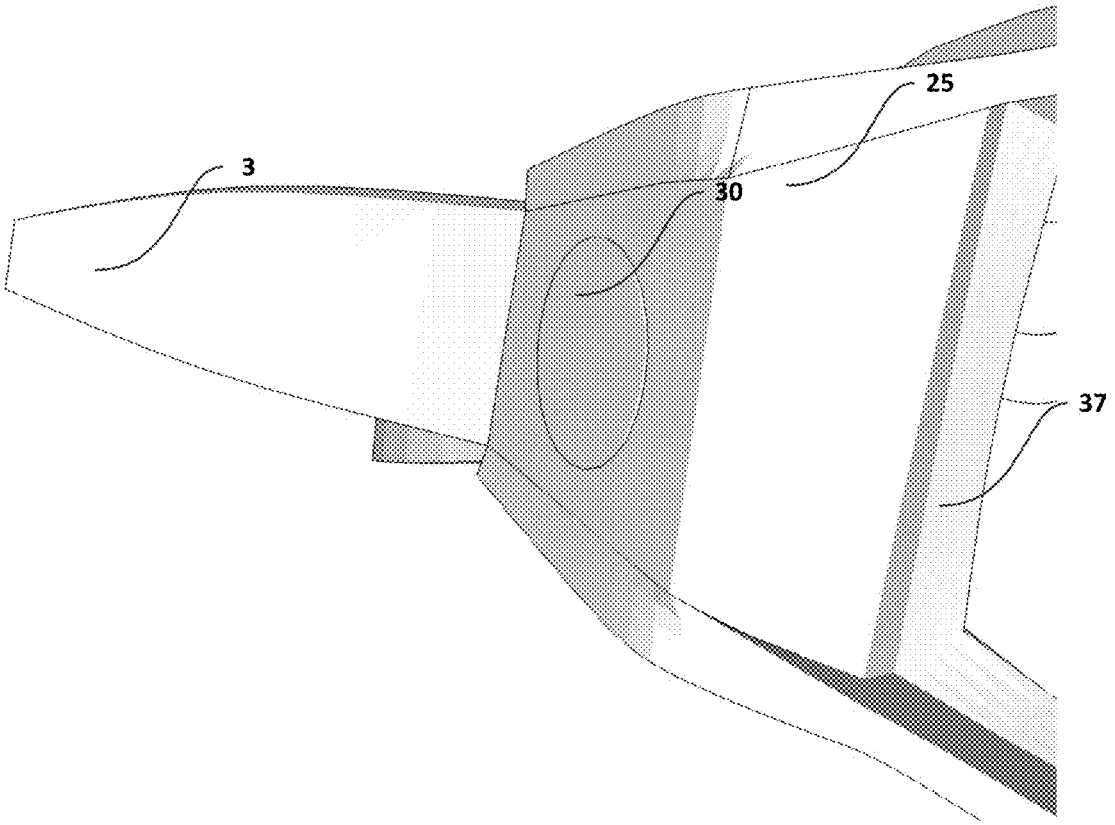
FIG. 5 is an perspective view that exhibits the circular band-release button on the side of the chemiluminescent frame.
Figure 6:
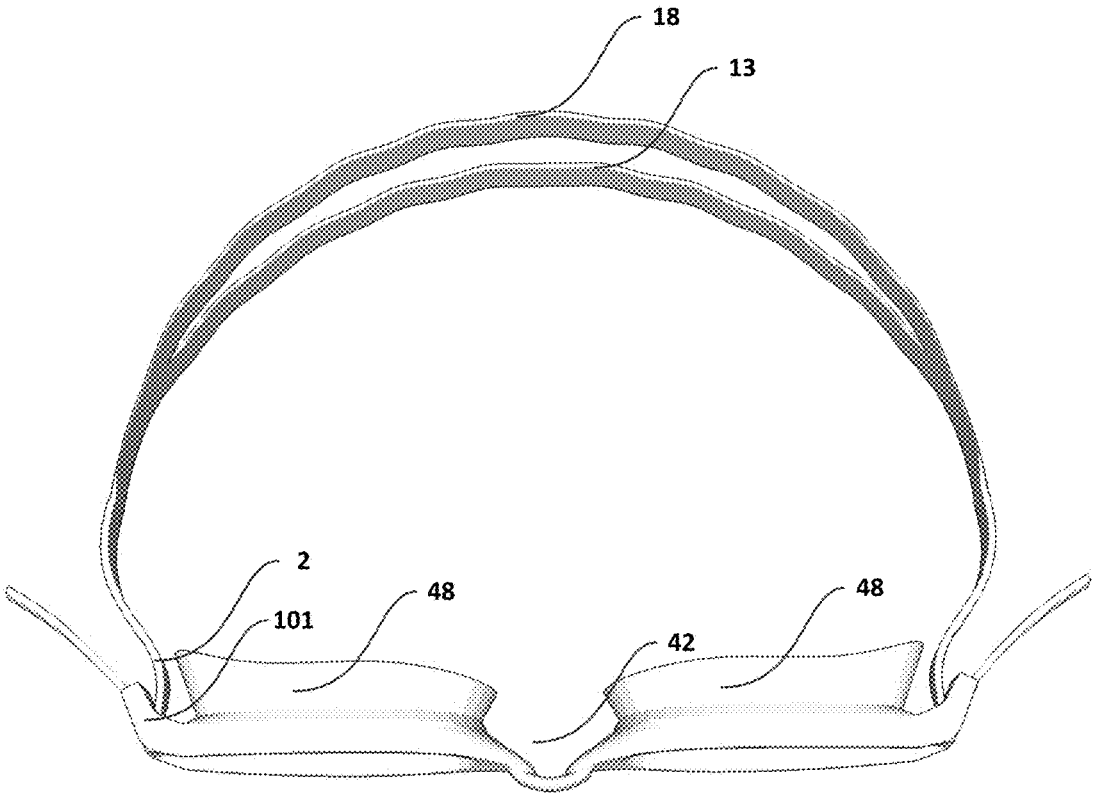
FIG. 6 is an birds-eye view that exhibits the shape of the wings of the chemiluminescent frames that the band is fed into so that the components are attached.
Figure 7:
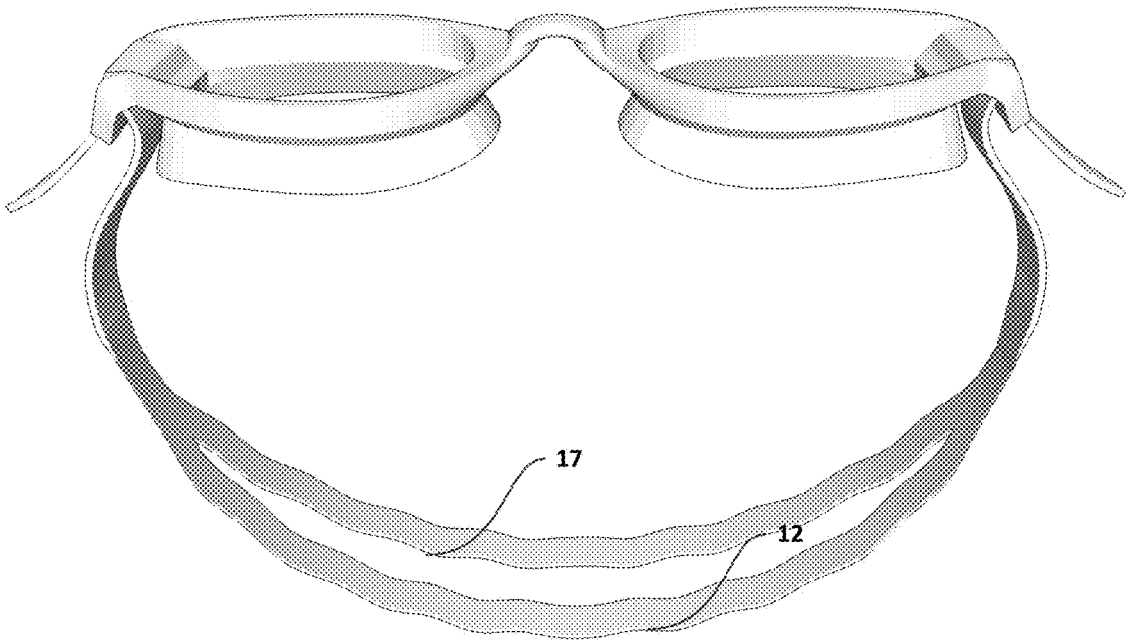
FIG. 7 is an bottom up view that exhibits the shape of the wings, from the ventral side of the chemiluminescent frames that the band is fed into so that the components are attached.

The invention comprises 4 sub-components: including the band 1, the connector 24, the connector clip 32, and the frame 33. Generally, in order for one to use the invention 1) a person would charges their goggles by putting them in front of a light (or sun) for a nominal period (depending on the intensity of light and flourophores used in the goggles) and then one would 2) go swimming at night, in a pool, lake, or other body of water for fun.

The band 1 connects the goggles to the head and is chemiluminescent. It comprises two sub-components, the connecting regions 2 and the grasping region 8, respectively. As for most types of goggles the purpose of the band is to hold the frame on the swimmers head. But it is also designed for another purpose which is to be visible at night from underwater. This visibility should be capable from other swimmers underwater and from those outside water. In order to achieve its visibility, the band 1 is preferably materially composed of both phosphorescent molecules and silicone. This is because that in the preferred embodiment, it is thought that the phosphorescent molecules 22 have to serve a brightness function, while the concentration of substrate such as silicone must be able to structurally hold the integrity of the required flexing demands. Thus, in other products that do not require the associated constant flexing of the substrate and immersion and removal from a persons head the concentration of phosphorescence molecules may be higher. And as such there is a preferred and range of concentrations for the phosphorescent molecules within the goggles. In the preferred embodiment, the phosphorescent molecules 22 should have a percent concentration of 30% by weight relative to the substrate, however it is thought that the percent concentration may vary from a minimum of 30% to a maximum of 40%, where the silicone substrate will likely breakdown and the substrate will be unusable. It is thought that concentrations less than 25% will not have the capability of being bright enough. This concentration is also ideal for rapid recharging in the pool lights, where a quick charge by the swimmer taking of their goggles and putting them in front of the pool lights. This will recharge them so they fluoresce for extended periods of time dependent on the duration of the charge and remain visible to people outside and inside the pool. The preferred phosphorescent molecules would be an alkaline earth metal aluminate, such as strontium aluminate activated with europium, silica aluminate. Other earth metals may be magnesium, calcium, barium and there may be silicon or titanium also present. In addition, the phosphorescent molecules may be zinc sulfide with copper, calcium sulfide with strontium sulfide and bismuth, or a zinc sulfide and calcium sulfide, though these are typically less bright than the aluminate.

Similarly, in the preferred embodiment, the substrate silicone 23 should have a percent concentration of 70% (by weight) relative to the phosphorescent molecules, however it is thought that the percent concentration may vary from a minimum of 40% by weight to a maximum of 75% weight depending on the desired brightness versus structural integrity performance of different products that may be created. While silicone is preferred it is thought that other thermoplastic elastomers may be used when mixed with the phophorescent molecules. These include styrenic block copolymers (TPE-s), polyolefin blends (TPE-o), elastomeric alloys (TPE-v or TPV), thermoplastic polyurethanes (TPU) thermoplastic copolyester or thermoplastic polyamides.

Additionally, it has preferred measurements that would enhance its visibility relative to the desired structural integrity. First, the preferred thickness is thought to be 2 mm (ranging from 0.5 mm for bands with lower concentration of phosphorescent molecules to 20 mm for very bright, though less flexible bands), in order to house a higher concentration of fluorescent materials and maintain the structural integrity. And second, the preferred length is thought to be 16 inches (ranging from 8 inches to 30 inches; depending on the size of the persons head for the target product i.e. (child vs. large male)).

At the ends of the band 1 are the connecting regions 1. The connecting regions 2 comprises two sub-components, the tapered end 3 and the locking structures 4, respectively. The connecting regions 2 are a region that can interchangeably attach to the frame 33, which is found in many goggle bands. Preferably it is composed of chemiluminescent materials, however other embodiments may be composed of any of the following: rubber composite, plastic composite, or polymer or be non luminescent. This is because the connecting portion of the band, may be more flexible than the grasping region and accommodate this feature by being less bright. Also it would preferably be smaller than the grasping region 8 (described below) and not be essential to the underwater visibility. For the connecting regions, there are several measurements, thought to be relevant to the operability of the connecting regions 2; First, the preferred length is thought to be 4 inches (ranging from 2 inches to 10 inches, for child vs. adult considerations) and should be as small as possible if composed of a non-chemiluminescent material. Next, the preferred thickness is thought to be 2 mm (ranging from 1 mm to 5 mm), which if chemiluminescent must be strong enough materially to withstand the adjustment and forces of wearing and adjusting the band. Finally, the preferred height is thought to be 0.5 inches (ranging from 0.125 inches to 1 inches), which is preferably based on the type of attachment to the frame. In general, the term connecting regions 2 is herein defined as the portion of the band 1 that interacts with the connector 24 and is preferably chemiluminescent.

In addition, the tapered end 3 interacts with the connector 24 portion of the frame by sliding through the connector aperture 26. This is a standard means to connect a band to a frame, band 1 by inserting it through the connector aperture 26. The tapered end 3 is preferably shaped like a rounded arrow however, it is thought that in alternative embodiments that it may also be shaped like a rounded corner, a rounded rectangle, or an triangle. A chemiluminescent tapered end would be important for attaching the band to the frame, if it ever became dislodged or unattached at night while swimming, especially due to the loss of visual acuity that would occur underwater. It is thought that for the purposes of this specification, the term tapered end 3 is herein defined as a chemiluminescent means to removably insert the band 1 into the connector 24. Further, around the connecting regions is one or more connector clips 32 which binds up the other floppy half of the band 1 when attached.

If the connector clip 32 is absent than it may be used without it, though some mechanism to prevent flopping of the band 1 is desirable.

The locking structures 4 are items present on the end of the band and serve as a means to stabilize the compressive forces of the band against the interacts with the connector clamp 27 within the connector 24 by a person pressing or releasing the connector button 30. They are ridges or grooves in the connecting region 2 of the band. In this invention, these locking structures would be preferably be composed of chemiluminescent material, which would enhance visibility if the goggles become detached underwater, however it is thought that chemiluminescence may be decreased or absent on these structures. In addition, in some embodiments, it is thought that if the locking structures 4 are absent overall than it is possible that the connector has clamping means that make it unnecessary for the band itself to have chemiluminescent locking structures 4. For example, the goggles may have a simple buckle (which may be chemiluminescent) that uses the folding as a lock down means. Or alternatively, there can be lift and clamp mechanism that secures the band. As is well known, but with the consideration that this may occur, in the dark and underwater with only the goggles as a light source, the locking structures 4 are used as follows. First, a person would locate the tapered ends 3. Next, a person depress the connector button 30. This in turn opens the connector clamp 27 which unblocks the connector aperture 26. Next, a person would insert the tapered end 3 through the connector aperture 26. Finally, a person releases the connector button 30, which closes the connector clamp 27 which locks the band 1 at the position. In an alternative locking structures embodiment (1) 5, these locking structures may comprise gripping teeth 6, which spatially, would be positioned on the connecting regions inner surface 7. In general, the term locking structures 4 is herein defined as chemiluminescent means that exist on the connecting regions 2 that enhance stability of the band elasticity, when worn by a person.

The grasping region 8 is the region on the band 1 that increases visibility within the water and preferably comprises two sub-components, the ventral piece 11 and the dorsal piece 14, respectively. Spatially, the grasping region 8 is positioned on the back of the head and within the center region of the band 1. It is chemiluminescent and has a large surface area relative to most swim goggles for enhanced visibility. The grasping region 8 is preferably shaped like two split wavy portions however, it is thought that in alternative embodiments that it may also be shaped like a one broad portion, which has similar surface area or alternately one slim portion, that is a stylistic choice by the wearer, but comes at the cost of decreased visibility at night for the wearer from behind. In order for someone to use the grasping region 8, it is like the normal steps of putting on goggles except that there are adjustments that increase visibility from behind. First, one puts on the band. Next, one adjusts the dorsal piece 14 dorsally for maximum night time visibility and comfort. Finally, one adjusts the ventral piece 11 ventrally for similar reasons. In an alternative embodiment, termed grasping region embodiment (1) 9, it has a single band 10, which is chemiluminescent and has a preferred length of 12 inches (ranging from 3 inches to 16 inches depending on the size of the users head) and a preferred thickness thought to be 2 mm (ranging from 1 mm to 15 mm). The preferred height of would be 0.5 inches (ranging from 0.25 inches to 2 inches).

The ventral piece 11 is one half of the grasping region and functions to both 1) increase the attachment interaction with a persons head, by having upwards forces as well as compressive forces and to 2) increase the visible surface area, that would be visible at night. It's preferred length is thought to be 12 inches (ranging from 3 inches to 16 inches), the preferred thickness is thought to be 2 mm (ranging from 1 mm to 15 mm) and the preferred height is thought to be 1 inches (ranging from 0.25 inches to 2 inches). Stylistically, in some embodiments, it is thought that if the ventral piece 11 is absent than it is possible that the ventral piece 11 and dorsal piece 14 may be combined into one piece, and the embodiment would not have the grasping region central aperture 19. The ventral piece has a relevant top 13 and bottom edge 12 that are preferably shaped like a wavy line however, it is thought that in alternative embodiments that it may also be shaped like a straight line or alternately like a curved line.

Similar to the ventral piece, the dorsal piece 14 is positioned dorsal to the ventral piece and functions to both 1) increase the attachment interaction with a persons head, by having downwards forces as well as compressive forces and to 2) increase the visible surface area, that would be visible at night. It has identical preferable measurements as the ventral piece 11. Again, if in some embodiments, the dorsal piece 14 is absent than it is possible that the ventral piece 11 and dorsal piece 14 are combined into one piece, that has the characteristics of only one of the pieces. In addition the outer surface 15 of the dorsal piece may comprise one a label 16 that advertises the product. The dorsal piece bottom edge 17 and top edge 18 are preferably shaped like a wavy line however, it is thought that in alternative embodiments that it may also be shaped like a straight line or alternately like a curved line.

Spatially, the grasping region central aperture 19 is positioned between the ventral piece 11 and dorsal piece 14 and is a means to separate the ventral piece 11 and dorsal piece 14 to adjust for maximum comfort and nighttime visibility. Its' preferred length is thought to be 12 inches (ranging from 3 inches to 16 inches depending on the size of the users head) and its preferred height is thought to be 0.5 inches (ranging from 0.25 inches to 2 inches).

The connector 24 is a means to connect the band 1 to the frame 33 and comprises 4 sub-components: including the connector casing 25, the connector clamp 27, the connector button 30, and the lens binder region 31. In some embodiments, the connector is chemiluminescent and in other embodiments it may not be. While it is ideal for all structures to be chemiluminescent, the connector may not be composed of the same material as the band or frame and takes up a relatively small visible surface area. Also, it is thought that if the connector 24 is absent than the lens 35 may integrate directly into the frame 33 and have a molded piece that is able to secure the band 1.

It's subcomponent the connector casing 25 element houses the components that connect the band 1 to the frame 33 and has a connector aperture 26 through which is the fastening means to connect the band 1 to the frame 33. The connector casing 25 is positioned on each lateral side of the frame 33, on the outside of the connector clamp 27, and peripheral to the connector button 30. The connector casing is mainly thought to be composed of chemiluminescent plastic however other embodiments may be composed of any of the following (chemiluminescent or non-chemiluminescent): rubber, silicone, or hard polymer. The composition of phosphorescent molecules in the casing may be higher than the band due to its lack of need for flexibility or contortions and as such may range from 20-50%. Further, if the connector casing 25 is absent it is thought there are alternatives embodiments that permit functionality. For example, in its absence it is possible that the band 1 connects directly to the frame. Further, it is possible that in its absence that it is possible that the band 1 connects directly to the mask or lens.

Spatially, the connector button 30 is positioned accessible to the individual and within the connector casing 25 and it interacts with the connector clamp 27 by a lever mechanism. It is thought that the push button mechanisms are more likely to be operable underwater and during the night, rather than buckle type mechanisms. Further, a chemiluminescent button may highlight (or even lack thereof, if the casing is chemiluminescent) its location through local contrast to help someone find the operating mechanism. However, it is thought that if the connector button 30 is absent than it is possible that any interactive means that can help immovably fasten the band 1 to the frame 33 may be used, such as a buckle or a lifting clamp. For the purposes of this specification, the term connector button 30 is a means to secure and unsecure the band 1 through a push button mechanism.

Operably connected to the connector button 30, the connector clamp 27 is housed within the connector casing 25 is positioned under the connector button 30. It interacts with the connector button 30 by clamping on the band 1 when the connector button 30 is released and functions to hold the band 1 in place, tight to the head. In some embodiments, if the connector clamp 27 is absent than it is possible that the connector 24 may be a simple buckle. Additionally, within the casing is the lens binder region 31 which is a means for the connector 24 to secure the lens 35 that may be encompassed by the mask 40. It is positioned medial within the casing towards the lens 35 and is a structural component and needn't be chemiluminescent.

The other main portion of the invention, besides the band 1 is the chemiluminescent frame 33 and it comprises two sub-components, the lens 35 and the mask 40, respectively. For the purposes of this specification, the term frame 33 is herein defined as the separate portion from band 1 that would be interchangeable with a different band. Spatially, the lenses 35 are positioned within the mask 40 and are comparable to lenses found in normal goggles in terms of their function (allow the person to see under water at night). A lens is mainly thought to be composed of plastic however other embodiments may be composed of any of the following: plexiglass, clear polymer, tempered glass, or glass. Structurally they preferably have features that allow them to attach to the mask 40. For example, in the preferred embodiment the lenses 35 are attached to the lens holder region 50 of the mask 40, which is the region that forms the operably binding elements to the mask. The lens outside lip 36 is one such element and is a means to insert the lens 35 into the mask 40 so that it is secure and water tight. It is preferably shaped like a crevasse. The lens holder region medial surface 51 has a lens protrusion 52 of the mask 40 interacts with it by inserting into crease and forming a seal. In some embodiments, it is thought that if the lens outside lip 36 is absent than the lens 35 may be formed as a portion of the mask 40.

Also in the preferred embodiment, the lens connector region 37 is the region that is attached to the lens binder region 31 of the connector 24, meaning that it is a structural component that allows the frame to have structural stability. Thus it stabilizes the lens 35 via the connector 24 and its attachment to the band 1. However, in some alternative embodiments, it is thought that if the lens connector region 37 is absent than the lens 35 may integrate directly into the frame 33. For example, having one molded piece that is able to secure the band 1.

The mask 40 is the chemiluminescent substrate that houses the lens 35 and attaches to the connector 24. It is preferably one piece that is composed of both phosphorescent molecules and silicone, preferably identical to the composition of the band 1 and preferably has the ability to swap out lenses. However it is thought that because the flexing and structural requirements of the mask is different from that of the band that it may have a different phosphorescence molecule concentration than the band. Further it may have different concentrations in different portions of the mask dependent on the physical requirements of the pieces.

It is though that the mask comprises 3 sub-components: including the nose piece region 42, the eye cup region 47, and the lens holder region 50. One goal of the mask 40 is to have the ability to swap out lenses. Similar to normal goggles, the nose piece region 42 is a piece or molded shape of a material that rests on the nose and attaches the lens 35. It is positioned on the swimmers nose. The nose piece region 42 attaches to the inside lens holder region 50 of the mask 40. It functions to both 1) bind the lens holder region 50 and form a chemiluminescent structural connection, so that in the dark, the orientation is clear which way to put the goggles on and 2) have a piece that supports the wearing of the frame 33. In alternative embodiment the nose piece may be non-chemiluminescent, its own piece and possibly composed of plastic.

The chemiluminescent eye cup region 47 of the mask 40 is a means to form a water tight seal around each eye. It interacts with the swimmers face by suctioning on the eye cup region inside surface 49. The eye cup region 47 is preferably shaped like an oval. All of the nose piece region 42, the eye cup region 47, and the lens holder region 50 are preferably chemiluminescent at concentrations similar to the requirements of the band.

While much effort is given to contemplating the various concentrations of phosphorescent molecules and substrates that will achieve these functions, it is appreciated that there are likely many viable concentrations in regions with different functional properties that are allowed by this invention as well.

We claim:

1. A goggle apparatus comprising:

a band, wherein said band comprises a connecting region and a grasping region and said band comprises a maximum concentration of band phosphorescent molecules to allow for maximum visible brightness in the dark and a minimum concentration of band thermoelastic polymer that allows maintenance of the structural integrity of said band during application and removal of said band, wherein said band phosphorescent molecules are earth metal aluminates, wherein said band earth metal aluminate concentration is greater than 25% concentration by weight relative to said band thermoelastic polymer and less than 45% concentration by weight relative to said band thermoelastic polymer, and a frame, wherein said frame comprises at least one lens, a mask that surrounds said lenses and a nosepiece wherein said mask comprises a concentration of phosphorescent molecules that allows for maximum visible brightness in the dark while having a minimum concentration of mask thermoelastic polymer in order to allow for maintenance of the structural integrity of said frame, wherein said mask phosphorescent molecules are also earth metal aluminates, wherein said mask earth metal aluminate concentration is greater than 25% concentration by weight relative to said mask thermoelastic polymer and less than 45% concentration by weight relative to said mask thermoelastic polymer, two connecting pieces that connect said band to said frame wherein said connecting pieces allow adjustment of said band length to accommodate the fit to the wearers head.

2. The apparatus of claim 1 wherein said nosepiece is chemiluminescent.

3. The apparatus of claim 2 wherein said nosepiece is chemiluminescent, is an identical chemical composition of said mask and is molded as one piece that separates two lenses housed within the mask.

4. The apparatus of claim 3 wherein said grasping region is further comprised of a ventral piece and dorsal piece wherein the height of the ventral piece and the dorsal piece is equivalent to that of the connecting region of said band.

5. The apparatus of claim 3 wherein said singular grasping region has a height larger than that of said connecting region.

6. The apparatus of claim 1 wherein said connecting pieces are chemiluminescent.

7. The apparatus of claim 6 wherein said connecting pieces are made of plastic and have mechanical means that operably clamp on said band and have mechanical means to release said clamp from said band allowing to adjust the length of said band and wherein said connector contains a connector button wherein said connector button has a differing concentration of phosphorescent molecules are also earth metal aluminates as compared to the mask.

8. The apparatus of claim 1 wherein the substrate silicone has a percent concentration between 40% by weight and 75% by weight relative to the phosphorescent molecules.

9. The apparatus of claim 1 wherein the band has a thickness ranging from 1 mm to 15 mm.

* * * * *